US007802620B2

(12) United States Patent
Arce et al.

(10) Patent No.: US 7,802,620 B2
(45) Date of Patent: Sep. 28, 2010

(54) CEMENTING HEAD

(75) Inventors: David A. Arce, Houston, TX (US); John L. Baugh, College Station, TX (US); Sidney K. Smith, Conroe, TX (US)

(73) Assignee: Baker Hughes Incorporated, Houston, TX (US)

( * ) Notice: Subject to any disclaimer, the term of this patent is extended or adjusted under 35 U.S.C. 154(b) by 295 days.

(21) Appl. No.: 11/184,388

(22) Filed: Jul. 19, 2005

(65) Prior Publication Data

US 2006/0027122 A1 Feb. 9, 2006

Related U.S. Application Data

(60) Provisional application No. 60/591,058, filed on Jul. 26, 2004.

(51) Int. Cl.
*E21B 33/13* (2006.01)

(52) U.S. Cl. ..... 166/75.15; 166/70; 166/177.4; 166/291; 175/52

(58) Field of Classification Search ..... 166/291, 166/70, 75.15, 177.4, 289; 137/268; 175/52
See application file for complete search history.

(56) References Cited

U.S. PATENT DOCUMENTS 4,491,177 A 1/1985 Baugh
5,758,726 A * 6/1998 Streich et al. ..... 166/379
6,182,752 B1 * 2/2001 Smith et al. ..... 166/70
6,702,043 B2 * 3/2004 Koch et al. ..... 175/52
6,776,228 B2 * 8/2004 Pedersen et al. ..... 166/75.15
2003/0155144 A1 8/2003 Saneto et al.
2005/0211431 A1 * 9/2005 Simson ..... 166/177.4

FOREIGN PATENT DOCUMENTS

EP 0837216 A2 4/1998

OTHER PUBLICATIONS http://education.yahoo.com/reference/dictionary/entry/door.*
Calvert, D.G., et al., "Improved Cementing Operations: A Field Study", SPE 23987, 1992, 443-452.
Seale, R., et al., "Multistage Fracturing System: Improving Operational Efficiency and Production", SPE 104557, 2006, 1-8.
Osazuwa, Peckins Osaze, "Successful Cementing in Medium Radius Sidetrack Wells; Niger Delta Experience", 2004, 1-6.

* cited by examiner

*Primary Examiner*—William P Neuder
*Assistant Examiner*—Sean D Andrish
(74) *Attorney, Agent, or Firm*—Steve Rosenblatt

(57) ABSTRACT

A tool for dropping one or more balls and then one or more darts features a closable ball drop opening that works automatically after the ball release to minimize damage to the subsequently released dart. A retainer keeps the darts from coming back up above the dart launcher in the event of a pressure surge in the well. The dart launcher features a dedicated movable barrel for each dart that can be locked in a fully misaligned and fully aligned position with the casing or tubular. A handle is retained to the dart housing and can be manipulated to defeat the lock and rotate a given barrel. The darts may be inspected in their respective barrels before launch and the launch order is variable.

21 Claims, 6 Drawing Sheets

CEMENTING HEAD

PRIORITY INFORMATION

This application claims the benefit of U.S. Provisional Application No. 60/591,058, filed on Jul. 26, 2004.

FIELD OF THE INVENTION

The field of this invention related to surface cementing heads for dropping balls and wiper plugs into a wellbore.

BACKGROUND OF THE INVENTION

In cementing casing or liners the procedure typically involves dropping one or more balls for engagement with a downhole seat sized for that ball to allow pressure buildup to set downhole devices such as external casing packers. After the ball is dropped and the downhole equipment is set, the delivery of the cement occurs in conjunction of delivery of one or more wiper plugs or darts down the casing. These plugs separate mud from cement or clean the inside of the casing.

Typically the ball-dropping device is located below the dart-releasing device so that the darts must travel past the ball-releasing device after it has dropped the balls. One problem with this layout is that the ball dropping device, after release of the ball, presents either a large opening or edges that can engage the trailing cups on the dart as it is pumped by. What has happened is that tears can develop in these cups allowing fluid bypass around the dart. This can stop the forward motion of the dart or impede its ability to separate fluids or to clean the inside wall of the casing or tubular as it is forced downhole. Accordingly, as described below with regard to the preferred embodiment, as solution to this problem has been devised to try to minimize the tendency to tear the darts as they pass the ball release device.

In another aspect, a provision is made to prevent the darts from coming back uphole, in the event of a pressure surge. Such darts are retained from traveling above their release mechanism. The release mechanism for the darts features, in the preferred embodiment, individual release barrels for each dart allowing for the darts to be dropped in any order. It further allows observation of what dart is in which barrel without affecting the operation of the other barrels holding other darts. Each barrel is movable between a fully misaligned and fully aligned position with the casing or tubular and can be locked in at least two positions. A handle assembly stays with the dart dropping unit and manipulation of the integrated operating handle acts to defeat the lock and rotate a barrel into an aligned position with the casing for launch of the dart.

U.S. Pat. No. 6,182,752 shows a tool that drops darts by continuing rotation in a fixed direction requiring a predetermined order of dropping once the darts are loaded and no provision for checking which dart is in which barrel after loading.

The above described advantages and other features of the invention will be more readily apparent to those skilled in the art from a review of the description of the preferred embodiment and the claims, which appear below.

SUMMARY OF THE INVENTION

A tool for dropping one or more balls and then one or more darts features a closable ball drop opening that works automatically after the ball release to minimize damage to the subsequently released dart. A retainer keeps the darts from coming back up above the dart launcher in the event of a pressure surge in the well. The dart launcher features a dedicated movable barrel for each dart that can be locked in a fully misaligned and fully aligned position with the casing or tubular. A handle is retained to the dart housing and can be manipulated to defeat the lock and rotate a given barrel. The darts may be inspected in their respective barrels before launch and the launch order is variable.

DETAILED DESCRIPTION OF THE PREFERRED EMBODIMENT

Figure 1:
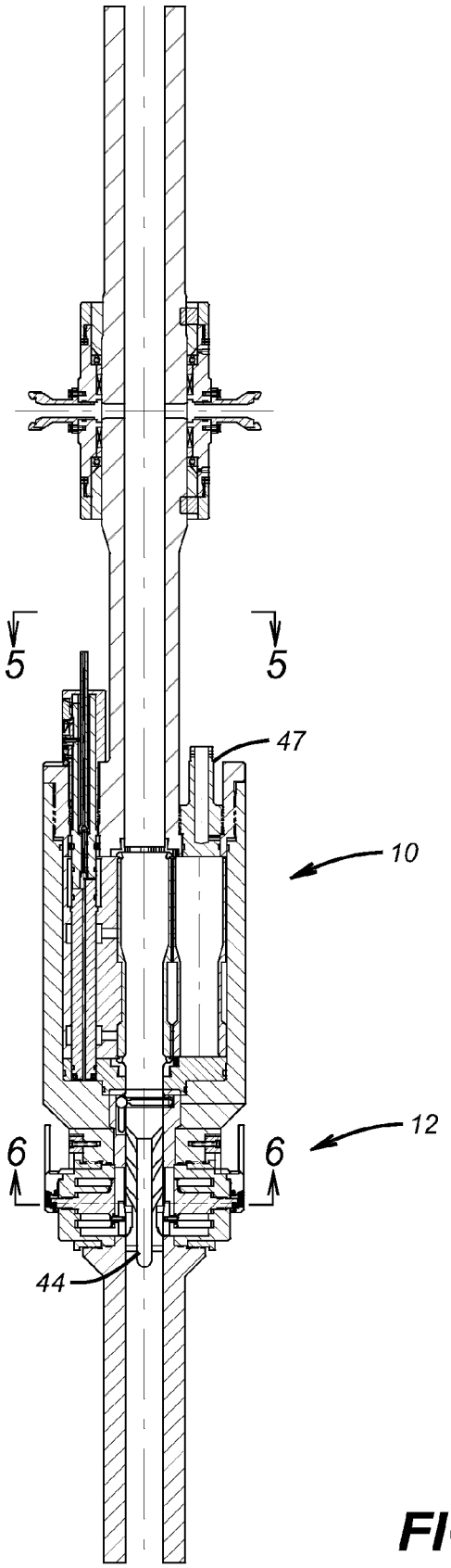
FIG. 1 is an elevation view of the assembly showing the dart dropping housing above the ball dropping housing.

Referring to FIG. 1, the plug or dart dropping housing 10 is mounted above the ball dropping housing 12. While one of each is illustrated those skilled in the art will appreciate that more than one of each can be used. The housing 12 is shown in greater detail in FIGS. 2-4. FIG. 4 will be used to describe the components of the housing 12. A handle 14 is mounted for 360 degree rotation of a cam 16. The handle 14 is secured by a pin 18 to cam 16. The casing or tubular 20 has an interior wall 22. A door 24 has a curved surface 26 designed to approximate the curvature of the interior wall 22 of the casing 20 when in the position shown in FIG. 4. The cam 16 has a guide rod 28 that extends into the door 24. A spring 30 surrounds rod 28 to bias the door 24 into a position where curved surface 26 is positioned as close as possible to the interior wall 22. Door 24 has an upper tapered surface 32 to ease its travel path up the outside wall 34 of the casing 20 when the handle 14 is rotated 180 degrees from the position shown in FIG. 4. The door 24 moves in tandem with the cam 16 because pin 28 secures the door 24 to the cam 16.

Figure 2:
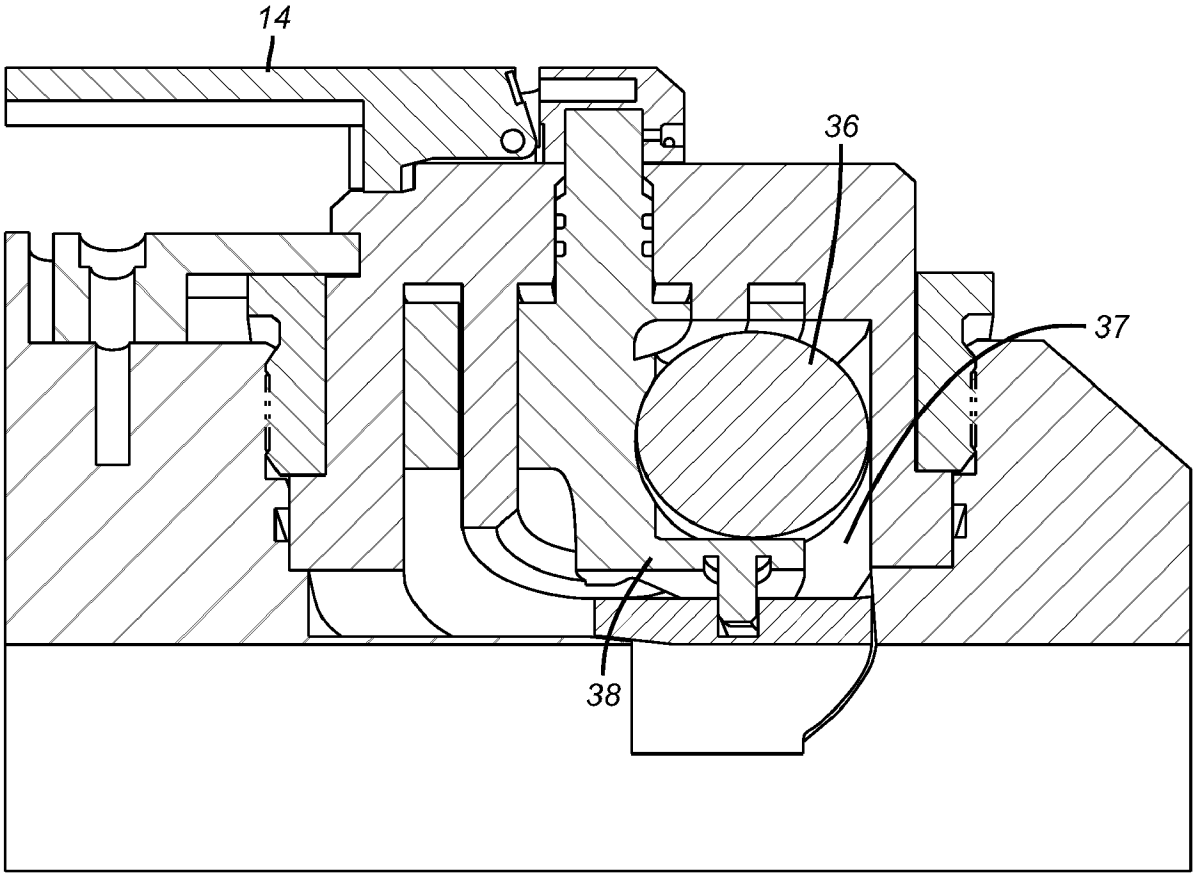
FIG. 2 is a section view of a ball trapped in the dropper before release.

The operation is best understood by going back to FIG. 2. There a ball 36 is loaded and retained in a space 37 by an extension 38 of the plug 16. Note that rod 28 extends into extension 38 for tandem movement. A curved ramp 41 can be seen in the out of contact position from the ball 36 when the handle 14 is pointing left in FIG. 2. As the handle 14 is rotated, the extension 38 takes rod 28 with it forcing the ramp 32 up the outside wall 34 of the casing 20 and up against the bias of spring 30 that surrounds rod 28.

Figure 3:
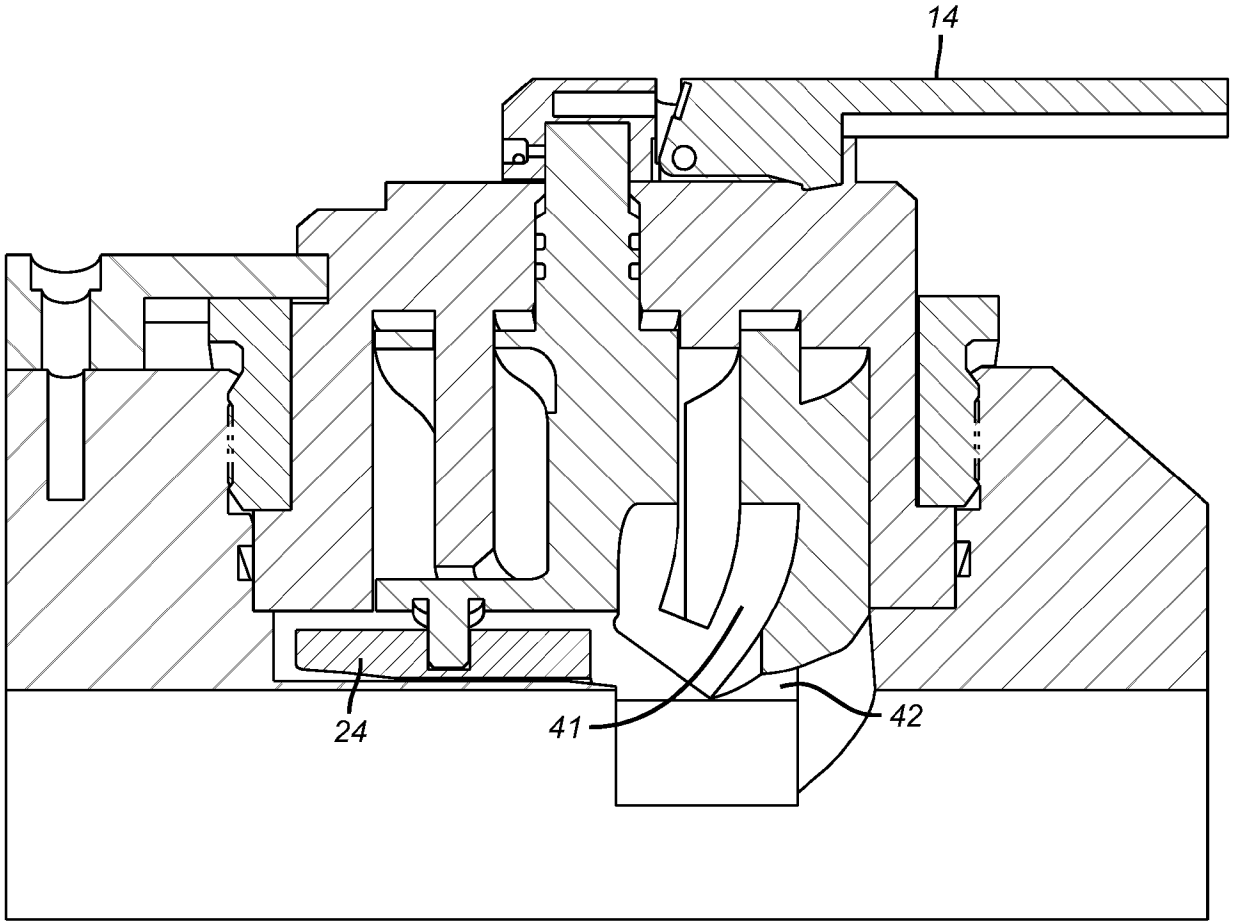
FIG. 3 is the view of FIG. 2 showing the door opened and the ball having been released.
Figure 4:
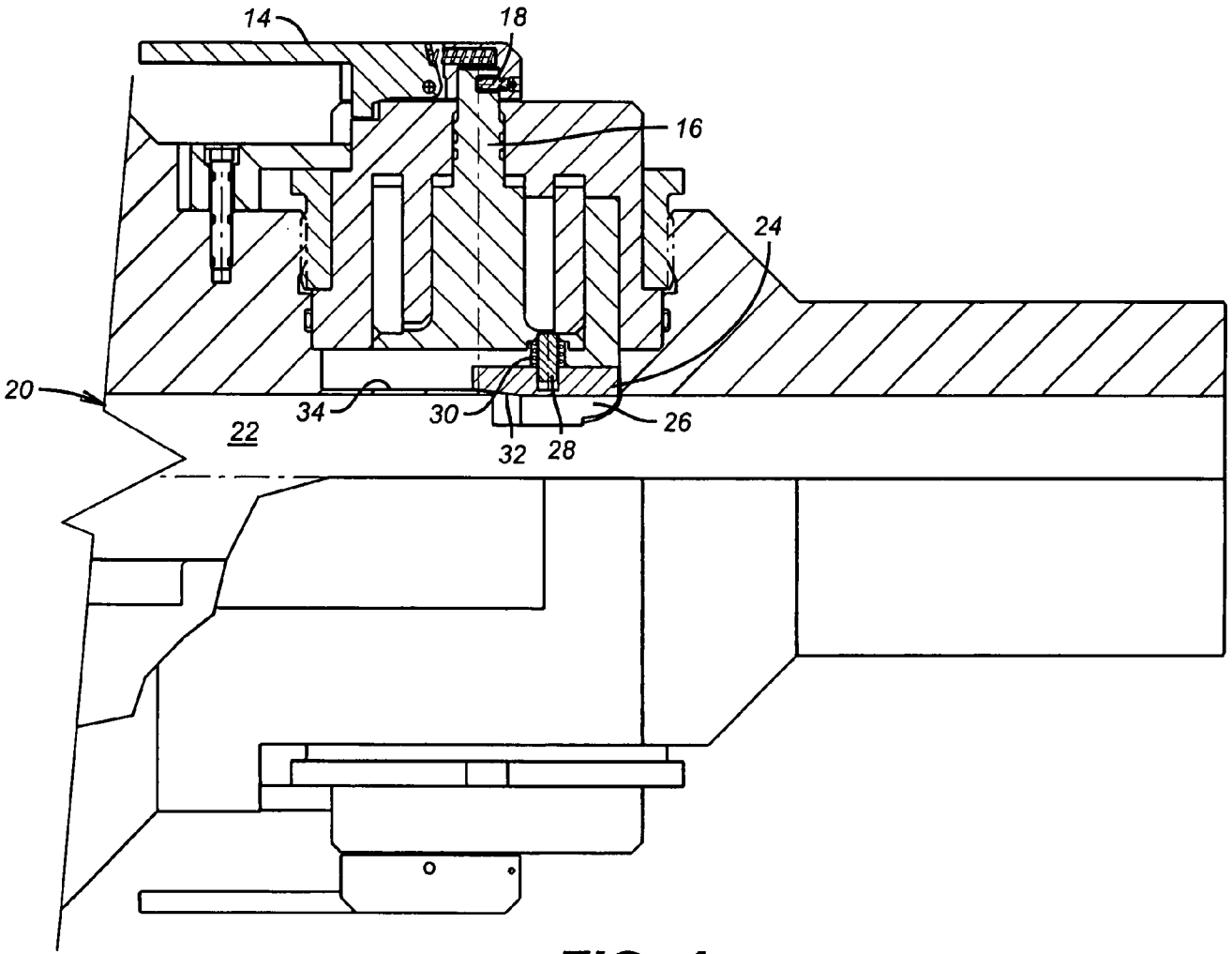
FIG. 4 shows the door to the casing closed before the darts are dropped.

The movement of handle 14 180 degrees to the FIG. 3 position takes door 24 away from opening 42 in the casing 20 allowing the curved ramp 41 to push the ball 36 through opening 42 and allow it to fall or be pumped downhole through casing 20.

After release of ball 36, the handle 14 is rotated another 180 degrees in either direction to allow door 24 to be again aligned with opening 42 and to allow the spring 30 to bias door 24 so that its curved surface 26 stays as closely aligned as possible with the inner wall 22. In this position it is selectively locked as shown schematically as 15 in FIG. 4. What will happen next is that a plug or dart will be dropped from housing 10. Because the door 24 with its curved surface 26 now sits in actual or near alignment with interior wall 22, there is a reduced chance of damage to the plug or dart 44 as it clears housing 12. The dart typically has one or more cups for sealing against the wall 22 of the casing 20 to allow it to be easily pumped down. These cups have caught on openings, sharp edges or ledges presented by the ball droppers of the prior designs and the result has been damage or destruction of the cups on the dart 44. The assembly described above with door 24 addresses this issue by closing the opening 42 after the ball is released and in a manner that minimizes pinch points that can damage the dart 44 that is subsequently dropped past opening 42.

Figure 6:
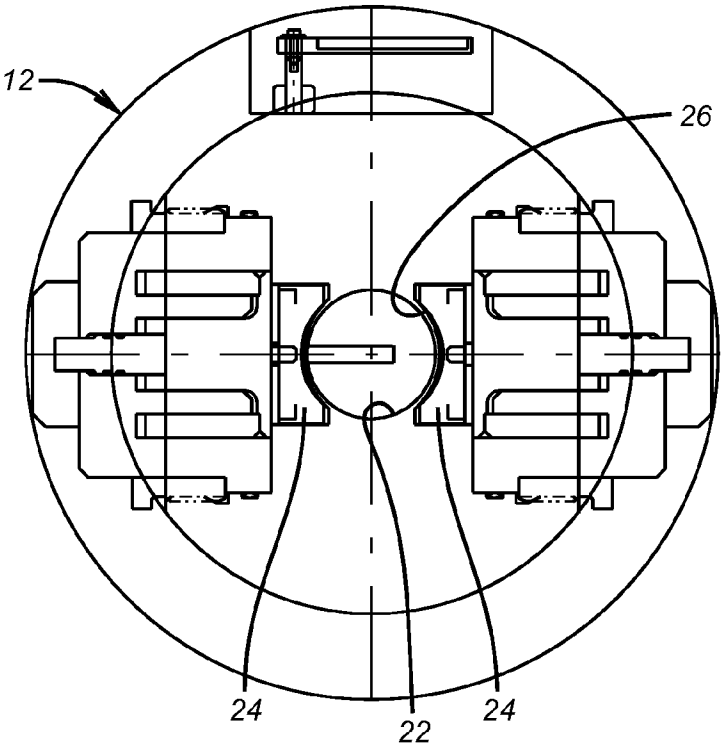
FIG. 6 is the view along line 6-6 of FIG. 1.

FIG. 6 illustrates that housing 10 can have mirror image ball dropping assemblies each having a door 24 that works in the above described manner and closes with surface 26 as nearly flush as possible with the interior surface 22 of the casing 20 so as to minimize subsequent damage to the dart 44. While reference has been made to a ball 36 those skilled in the art will appreciate that other shapes can be used and that fluid pressure rather than curved ramp 41 can be used to get the ball 36 out.

Figure 5:
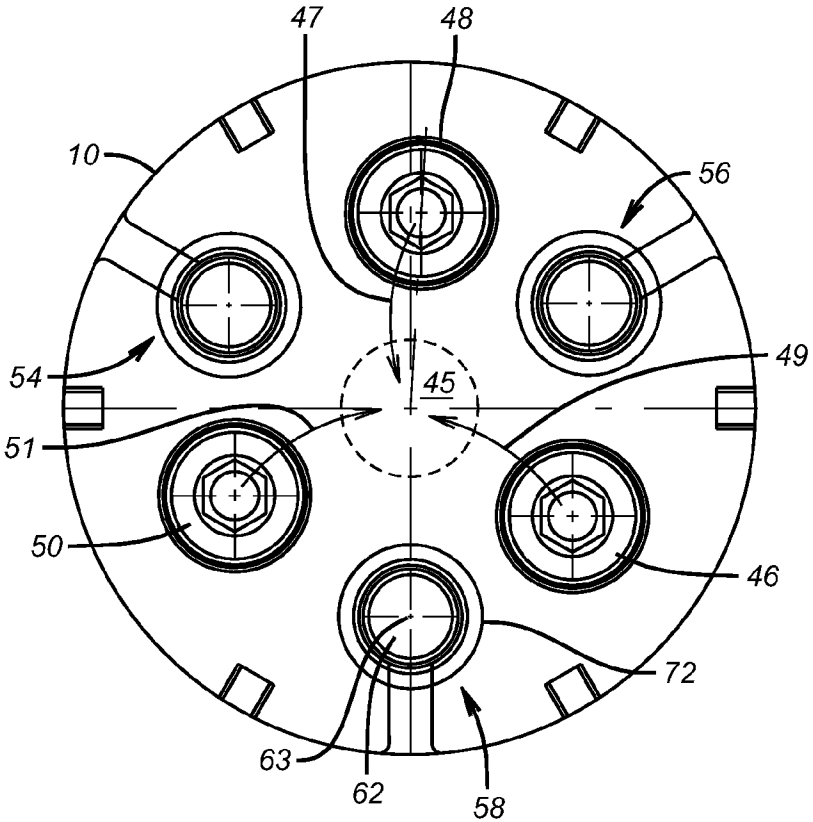
FIG. 5 is the view along line 5-5 of FIG. 1.
Figure 7:
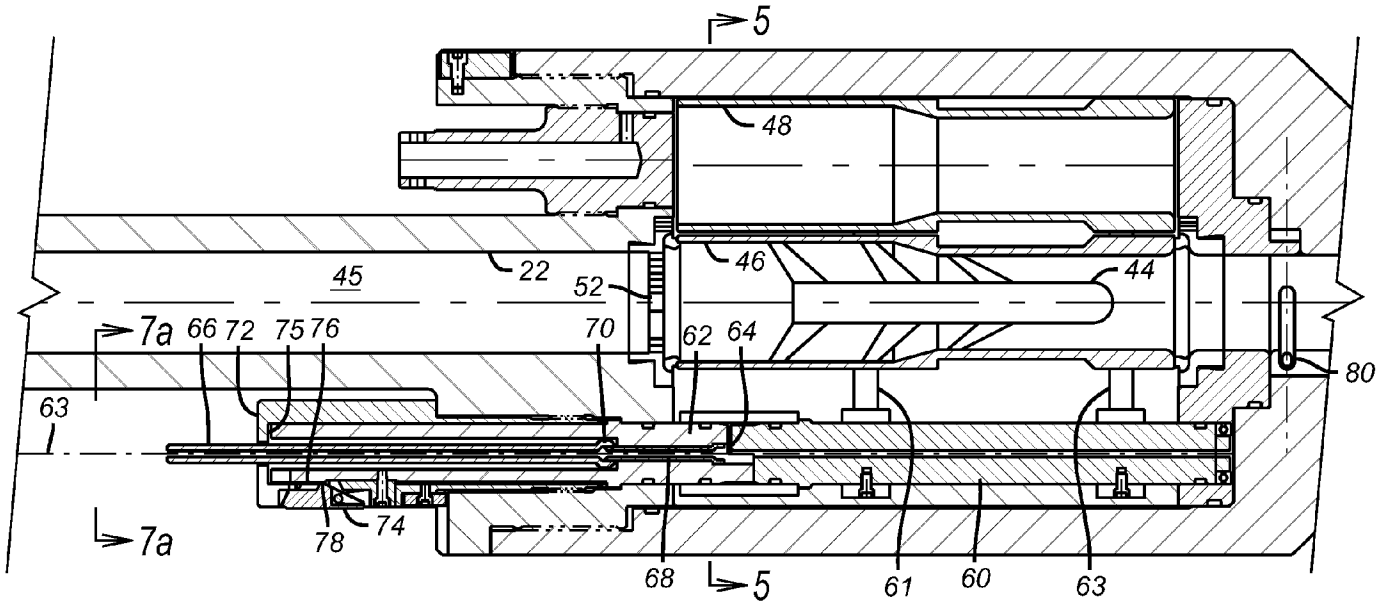
FIG. 7 is an enlarged view of the dart dropper showing the lock and handle feature.
Figure 7A:
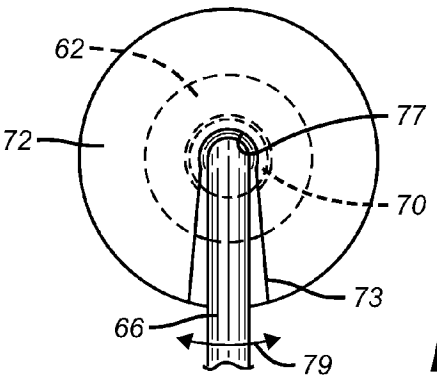
FIG. 7*a* is a view along lines 7-7 of FIG. 7 with the handle extended out fully vertically and then rotated into a perpendicular horizontal plane.

Referring now to FIGS. 6 and 7, the details of the dart dropping housing 10 will be explained. Housing 12 has a central bore 45. For illustrative purposes, there are three barrels 46, 48 and 50 that are each independently rotatable into or out of alignment with bore 45 and two of which 46 and 48 are shown in FIG. 7. Each barrel can be locked in either position and features an integral handle assembly that can defeat the lock to facilitate rotation. An open barrier 52 is within the inner wall 22 that continues below as part of the casing 20, as shown in FIG. 4. This barrier keeps the darts 44 from going further up beyond housing 10 in the event of a pressure surge in the well. At the same time, because barrier 52 is open, flow can pass through it to allow pumping the dart 44 down the casing 20. FIG. 5 shows the operating shaft assemblies 54, 56 and 58 that respectively operate barrels 46, 48 and 50. One shaft assembly will be described in detail, as in the preferred embodiment they are all identical. A lower shaft 60 is linked (preferably by meshing gears, not shown) or via arms 61 and 63 for rotation of a barrel such as 46 about an arc 49 as shown in FIG. 5. Similarly, barrels 48 and 50 are respectively independently rotated about arcs 47 and 51 by their operators 56 and 54. An upper shaft 62 is keyed to lower shaft 60 at connection 64. A handle 66 is screwed to bolt 68 in the stowed position. A ball 70 at the lower end of handle 66 keeps the handle within cap 72 after the handle is unthreaded from bolt 68 and lifted away from bolt 68 up to the point where ball 70 is stopped by travel stop 75. A dog 74 extends into a groove 76 in upper shaft 62. When the handle 66 is pulled away from bolt 68 until ball 70 stops further outward travel of the handle 66, the handle 66 is rotated to a position perpendicular to axis 63 while still retained by the shaft 62 to engage the dog 74 to cam it away from groove 76 along mating tapers 78. While still engaged by shaft 62, the handle can rotate about axis 63 in an opening 73, see FIG. 7*a*, that is sufficiently wide to allow handle 66 to rotate shaft 62 well under 60 degrees to align or misalign a barrel such as 46 with the central bore 45. FIG. 7*a* has been added to show the handle pulled all the way up along axis 63 and turned to a plane perpendicular to axis 63 and then rotatable in that plane perpendicular to axis 63 to align a barrel in the passage 45. The bell 70 can be unthreaded from 68 and raised straight up inside shaft 62 along axis 63. The opening 77 on top of cap 72 is smaller than the receptacle 70 preventing it from coming straight out of shaft 62 along axis 63. When the handle is fully extended along axis 63 until it hits opening 77 in cap 72, the handle can be turned 90 degrees into gap 73 in the side of cap 72. In the position of FIG. 7*a* the handle 66 can turn left or right as shown by arrows 79. Since the top of shaft 62 is also slotted in alignment with slot 73, the left or right movement 79 of handle 66 will turn shaft 62 and 60 which move in tandem. Handle 66 is not removable from shaft 62. At this point dog 74 snaps into another groove 76 to lock the barrel 46 in the position of alignment with bore 45. An indicator 80 of a type known in the art signals the passage of dart 44 out of barrel 46. The other darts 44 in the other barrels 48 and 50 can then be released in the same way, after barrel 46 is retracted out of alignment with bore 45.

This arrangement offers advantages over prior dart dropping designs. One is that each barrel can be inspected to be sure there is a dart 44 in it before the cementing procedure starts. The darts 44 can then be dropped in any desired order. The handle 66 that operates an individual barrel cannot be lost as it is made to be retained by the cap 72. Any of the barrels can be selectively locked in the drop position where there is alignment with bore 45. The locking is automatic upon rotation into position and dog 74 falling into slot 76 when barrel 46 aligns with bore 45, for example. By manipulating the handle, after dropping the dart 44 the dog is retracted allowing the reverse movement to occur to fully misalign barrel 46 from bore 45 and lock that position as dog 74 falls into another slot (not shown) on cap 72. Again the other barrels preferably work in the same manner.

While three barrels in one housing 10 are shown, varying numbers of barrels can be used in each housing. Shafts 60 and 62 can be in one piece and can also be power driven as opposed to manual handle 66.

Using the combination of equipment described above, one or more objects of the same or different dimensions can be dropped from housing 12 followed by closure of the opening or openings 42 with a door 24 to present a flush or nearly flush surface 26 adjacent the inner wall 22 of the casing 20. The darts 44 can then be dropped in any order from a given housing 10 with little concern about damage as they pass openings 42 that are covered with a door 24 that is flush or nearly so. If there is a pressure surge as the darts are being dropped, the barrier 52 prevents them from being blown past the housing 10. The built in handle 66 can't be lost. The barrels 46, 48 and 50 can be selectively locked in a fully aligned position with bore 45 or in a fully misaligned position or any other desired position. The dog 74 engages a groove such as 76 automatically and can be defeated by permitted movements of the handle 66 within cap 72.

While the preferred embodiment has been set forth above, those skilled in art will appreciate that the scope of the invention is significantly broader and as outlined in the claims which appear below.

We claim:

1. A device for dropping at least one object into a wellbore, comprising:

a housing having a through passage that can be connected to the wellbore, said passage defined by a peripheral wall that defines its length;

at least one object storage space outside said passage and in said housing for storage of an said object out of alignment with said passage before release into said passage;

at least one opening from said object storage space though said wall that defines said passage, said at least one opening being selectively and fully closed at said wall in a manner that avoids pinch points for a subsequent passing object by at least one door having a periphery that extends across the entire at least one wall opening conforming to the shape and curvature of said at least one wall opening and positioned in said at least one opening adjacent the curvature of said wall after release of the object into said passage.

2. The device of claim 1, wherein:

said at least one door has a face contoured to the shape of said passage so as to present a substantially flush surface in said wall when placed in said at least one opening.

3. The device of claim 1, further comprising:

at least one cam to open said at least one opening.

4. The device of claim 3, wherein:

said at least one cam operates at least one door that selectively closes said at least one opening after moving said at least one door away from said at least one opening.

5. The device of claim 4, wherein:

said at least one door is biased into said at least one opening when substantially aligned therewith.

6. The device of claim 5, wherein:

said bias is overcome by operation of said cam to allow said at least one door to retract within said at least one space when being moved away from said at least one opening.

7. A device for dropping at least one object into a wellbore, comprising:

a housing having a longitudinal axis and a passage aligned with a lower end outlet that can be connected to the wellbore;

a plurality of barrels within said housing, each barrel adapted to retain said object outside said passage, each said barrel having an open lower end that is closed by a lower end of said housing when the barrel is outside said passage and each barrel independently able to swivel with respect to another barrel that can remain stationary for alignment of said lower open end of said barrel with said passage and said lower end outlet of said housing in more than a single order, said alignment removing a closure at said lower end of said barrel previously provided by said lower end of said housing to provide an open path to the wellbore for said object through the lower end outlet of said housing.

8. The device of claim 7, wherein:

said housing having an inspection access to allow examination of said object in at least one of said barrels when said barrel is not aligned with said passage.

9. The device of claim 7, further comprising:

an operator for moving at least one of said barrels into and out of substantial alignment with said passage.

10. The device of claim 9, wherein:

said housing having an inspection access to allow examination of said object in at least one of said barrels when said barrel is not aligned with said passage;

said passage further comprising an obstructing member near an end thereof that allows flow therethrough but prevents said object released from one of said barrels from passing if a pressure surge from the wellbore drives it in a direction going out of the wellbore.

11. A device for dropping at least one object into a wellbore, comprising:

a housing having a passage that can be connected to the wellbore;

a plurality of barrels within said housing, each barrel adapted to retain said object outside said passage and each barrel independently movable with respect to another barrel that can remain stationary for alignment with said passage in more than a single order for launching said object through said passage into the wellbore;

said passage further comprising an obstructing member near an end thereof that allows flow therethrough but prevents said object released from one of said barrels from passing if a pressure surge from the wellbore drives it in a direction going out of the wellbore.

12. A device for dropping at least one object into a wellbore, comprising:

a housing having a passage that can be connected to the wellbore;

a plurality of barrels within said housing, each barrel adapted to retain said object outside said passage and each barrel independently movable with respect to another barrel that can remain stationary for alignment with said passage in more than a single order for launching said object through said passage into the wellbore;

an operator for moving at least one of said barrels into and out of substantial alignment with said passage;

said operator comprises a handle that can be stowed substantially within said operator.

13. The device of claim 12, wherein:

said handle is extendable without being removable from said operator.

14. The device of claim 13, wherein:

said handle can be rotated from a position it assumes when substantially within said operator to a second position in a plane substantially perpendicular to said operator to facilitate rotation of said operator for selective alignment and misalignment of at least one said barrel with said passage.

15. The device of claim 14, further comprising:

a biased docking dog on said housing to selectively lock said operator into a position where at least one said barrel is in substantial alignment with said passage, said latch is overcome when said rotation of said operator is reversed.

16. A method of dropping a second object from a second device into a wellbore from above a first device that had previously dropped a first object into the wellbore, comprising:

mounting the second device above the first device to create a common passage defined by a wall;

dropping said first object through an opening in said wall in said first device into said passage;

selectively fully closing said opening in said wall in said first device by a door having a periphery that extends across the entire wall opening which conforms to the shape and curvature of said wall opening and positioned in said opening adjacent the curvature of said wall, after release of the first object from said first device into said passage, in a manner that avoids pinch points for a subsequent passing of said second object from said second device, while leaving said passage unobstructed.

17. The method of claim 16, comprising:

shaping said door to conform to the shape of said common passage when placed in said opening.

18. The method of claim 16, comprising:

allowing said first object to pass through said opening as said door is retracted from said opening;

mounting said door with a bias so that said door is biased for a substantially flush closure of said opening and to allow said door to retract to allow cam rotation to let said first object move through the opening left by movement of said door.

19. The method of claim 16, comprising:

mounting at least three second objects in said second device outside said passage that leads to the wellbore;

aligning said second objects with said passage in any desired order.

20. The method of claim 19, comprising:

providing a barrier in said passage that allows said second objects to be pumped down said passage but preventing them from coming back due to wellbore pressure beyond said barrier.

21. The method of claim 20, comprising:

selectively locking said alignment of said second objects with said passage;

using a wiper dart for said second objects and a ball for said first object.

* * * * *